US007605116B2

(12) United States Patent
Brooker et al.

(10) Patent No.: US 7,605,116 B2
(45) Date of Patent: Oct. 20, 2009

(54) HIGHLY WATER-SOLUBLE SOLID LAUNDRY DETERGENT COMPOSITION THAT FORMS A CLEAR WASH LIQUOR UPON DISSOLUTION IN WATER

(75) Inventors: Alan Thomas Brooker, Newcastle upon Tyne (GB); Kevin Lee Kott, Newcastle upon Tyne (GB); Nicola Ethel Davidson, Newcastle upon Tyne (GB); Lindsey Heathcote, Northumberland (GB); John Peter Eric Muller, Newcastle upon Tyne (GB); Mark Allen Smerznak, Tyne & Wear (GB); Nigel Patrick Sommerville-Roberts, Newcastle upon Tyne (GB); Kenji Shindo, Kobe (JP); Emmanuel Pantelis Fakoukakis, Cincinnati, OH (US); Jason Christopher King, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 414 days.

(21) Appl. No.: 11/201,523

(22) Filed: Aug. 11, 2005

(65) Prior Publication Data

US 2006/0035802 A1 Feb. 16, 2006

Related U.S. Application Data

(60) Provisional application No. 60/600,464, filed on Aug. 11, 2004.

(51) Int. Cl.

| | |
|---|---|
| ***C11D 1/12*** | (2006.01) |
| ***C11D 1/29*** | (2006.01) |
| ***C11D 1/65*** | (2006.01) |
| ***C11D 3/10*** | (2006.01) |
| ***C11D 17/06*** | (2006.01) |

(52) U.S. Cl. ..... 510/351; 510/352; 510/438; 510/443; 510/444; 510/452; 510/498; 510/509

(58) Field of Classification Search ..... 510/351, 510/352, 438, 443, 444, 452, 498, 509
See application file for complete search history.

(56) References Cited

U.S. PATENT DOCUMENTS

| | | | | |
|---|---|---|---|---|
| 4,487,710 | A | 12/1984 | Kaminsky | |
| 4,764,292 | A * | 8/1988 | Sepulveda et al. | 510/330 |
| 5,663,136 | A | 9/1997 | Van Dijk et al. | |
| 6,235,704 | B1 * | 5/2001 | Detering et al. | 510/480 |
| 6,369,020 | B1 * | 4/2002 | Kohlus et al. | 510/438 |
| 6,677,289 | B1 * | 1/2004 | Price et al. | 510/303 |
| 6,939,841 | B2 * | 9/2005 | Requejo | 510/446 |

FOREIGN PATENT DOCUMENTS

| | | | |
|---|---|---|---|
| DE | 2355940 | | 5/1974 |
| EP | 0634484 | A1 | 1/1995 |
| GB | 1408969 | | 10/1975 |
| GB | 1408970 | | 10/1975 |
| WO | WO 00/18856 | A1 * | 4/2000 |
| WO | WO 00/18870 | A1 * | 4/2000 |
| WO | WO 00/34422 | A2 * | 6/2000 |
| WO | WO 00/39274 | | 7/2000 |

* cited by examiner

*Primary Examiner*—Lorna M Douyon
(74) *Attorney, Agent, or Firm*—Gary J. Foose; David V. Upite; Kim W. Zerby

(57) ABSTRACT

A solid laundry detergent composition comprising: (a) from 0.1 wt % to 10 wt % of an alkoxylated anionic detersive surfactant; (b) from 1 wt % to 25 wt % of an non-alkoxylated anionic detersive surfactant; (c) from 0 wt % to 4 wt % zeolite builder; (d) from 0 wt % to 4 wt % phosphate builder; and (e) from 0 wt % to 10 wt % silicate salt.

21 Claims, No Drawings

HIGHLY WATER-SOLUBLE SOLID LAUNDRY DETERGENT COMPOSITION THAT FORMS A CLEAR WASH LIQUOR UPON DISSOLUTION IN WATER

CROSS REFERENCE TO RELATED APPLICATION

This application claims the benefit of U.S. Provisional Application No. 60/600,464, filed 11 Aug. 2004.

TECHNICAL FIELD

The present invention relates to a highly water-soluble solid laundry detergent composition that upon dissolution in water forms a clear wash liquor. More specifically, the present invention relates to a solid laundry detergent composition comprising an anionic detersive surfactant system and low or no levels of zeolite builder, phosphate builder and silicate salt.

BACKGROUND

Granular laundry detergent compositions need to have a very good fabric-cleaning performance against a wide variety of soil types. Granular laundry detergents also need to have very good dispensing and dissolution profiles. However, a dichotomy may exist in that some reformulations of the granular laundry detergent composition to improve its fabric-cleaning performance may negatively impact its dispensing and dissolution profiles, and vice versa. It is very difficult to improve the cleaning performance, dispensing profile and dissolution profile of a granular laundry detergent composition at the same time. Furthermore, it is also desirable for highly water-soluble granular laundry detergent compositions to form a clear wash liquor upon dissolution in water. This is because having a clear wash liquor is a desired consumer signal that the granular laundry detergent composition has dissolved.

Anionic detersive surfactants are incorporated into granular laundry detergent compositions in order to provide a good fabric-cleaning benefit. For example, GB 1408969, GB 1408970, U.S. Pat. No. 4,487,710, U.S. Pat. No. 5,663,136 and WO2004/041982 all relate to compositions comprising anionic detersive surfactants. However, the anionic detersive surfactant is capable of complexing with free cations, such as calcium and magnesium cations, that are present in the wash liquor in such a manner as to cause the anionic detersive surfactant to precipitate out of solution, which leads to a reduction in the anionic detersive surfactant activity. In extreme cases, these water-insoluble complexes may deposit onto the fabric resulting in poor whiteness maintenance and poor fabric integrity benefits. This is especially problematic when the laundry detergent composition is used in hard-water washing conditions when there is a high concentration of calcium cations.

The anionic detersive surfactant's tendency to complex with free cations in the wash liquor in such a manner as to precipitate out of solution is mitigated by the presence of builders, such as zeolite builders and phosphate builders, which have a high binding constant with cations such as calcium and magnesium cations. These builders sequester free calcium and magnesium cations and reduce the formation of these undesirable complexes. However, zeolite builders are water-insoluble and their incorporation in laundry detergent compositions leads to poor dissolution of the laundry detergent composition and can also lead to undesirable residues being deposited on the fabric. In addition, detergent compositions that comprise high levels of zeolite builder form undesirable cloudy wash liquors upon contact with water. Whilst phosphate builders allegedly do not have favourable environmental profiles and their use in laundry detergent compositions is becoming less common; for example, due to phosphate legislation in many countries.

Detergent compositions comprising alkyl benzene sulphonate and alkyl ethoxylated sulphate detersive surfactants are described in GB 1408969, GB 1408970, U.S. Pat. No. 4,487,710 and U.S. Pat. No. 5,663,136. A detergent composition comprising an anionic detersive surfactant and a non-ionic detersive surfactant that allegedly gives enhanced stain removal at a wide range of water-hardness is described in WO2004/041982. A combination of a granular detergent and a packaging system having a low moisture vapour transfer rate is described in EP634484.

There remains a need for a granular laundry detergent composition comprising an anionic detersive surfactant having a good fabric-cleaning performance, especially a good greasy stain cleaning performance, good whiteness maintenance, and very good dispensing and dissolution profiles, and which upon dissolution in water gives a clear wash liquor.

SUMMARY

The present invention provides a solid laundry detergent composition comprising: (a) from 0.1 wt % to 10 wt % of an alkoxylated anionic detersive surfactant; (b) from 1 wt % to 25 wt % of an non-alkoxylated anionic detersive surfactant; (c) from 0 wt % to 4 wt % zeolite builder; (d) from 0 wt % to 4 wt % phosphate builder; and (e) from 0 wt % to 10 wt % silicate salt.

DETAILED DESCRIPTION

Alkoxylated Anionic Detersive Surfactant

The composition comprises from 0.1 wt % to 10 wt % of an alkoxylated anionic detersive surfactant. This is the optimal level of alkoxylated anionic detersive surfactant to provide good greasy soil cleaning performance, to give a good sudsing profile, and to improve the hardness tolerancy of the overall detersive surfactant system. It may be preferred for the composition to comprise from 3 wt % to 5 wt % alkoxylated anionic detersive surfactant, or it may be preferred for the composition to comprise from 1 wt % to 3 wt % alkoxylated anionic detersive surfactant.

Preferably, the alkoxylated anionic detersive surfactant is a linear or branched, substituted or unsubstituted $C_{12-18}$ alkyl alkoxylated sulphate having an average degree of alkoxylation of from 1 to 30, preferably from 1 to 10. Preferably, the alkoxylated anionic detersive surfactant is a linear or branched, substituted or unsubstituted $C_{12-18}$ alkyl ethoxylated sulphate having an average degree of ethoxylation of from 1 to 10. Most preferably, the alkoxylated anionic detersive surfactant is a linear unsubstituted $C_{12-18}$ alkyl ethoxylated sulphate having an average degree of ethoxylation of from 3 to 7.

Preferably, at least part of, more preferably all of, the alkoxylated anionic detersive surfactant is in the form of a non-spray-dried powder such as an extrudate, agglomerate, preferably an agglomerate. This is especially preferred when it is desirable to incorporate high levels of alkoxylated anionic detersive surfactant in the composition.

The alkoxylated anionic detersive surfactant may also increase the non-alkoxylated anionic detersive surfactant activity by making the non-alkoxylated anionic detersive surfactant less likely to precipitate out of solution in the presence of free calcium cations. Preferably, the weight ratio of non-alkoxylated anionic detersive surfactant to alkoxylated anionic detersive surfactant is less than 5:1, or less than 3:1, or less than 1.7:1, or even less than 1.5:1. This ratio gives optimal whiteness maintenance performance combined with a good hardness tolerency profile and a good sudsing profile. However, it may be preferred that the weight ratio of non-alkoxylated anionic detersive surfactant to alkoxylated anionic detersive surfactant is greater than 5:1, or greater than 6:1, or greater than 7:1, or even greater than 10:1. This ratio gives optimal greasy soil cleaning performance combined with a good hardness tolerency profile, and a good sudsing profile. Suitable alkoxylated anionic detersive surfactants are: Texapan LEST™ by Cognis; Cosmacol AES™ by Sasol; BES151™ by Stephan; Empicol ESC70/U™; and mixtures thereof.

Non-alkoxylated Anionic Detersive Surfactant

The composition comprises from 1 wt % to 25 wt % of a non-alkoxylated anionic detersive surfactant. This is the optimal level of non-alkoxylated anionic detersive surfactant to provide a good cleaning performance. It may be preferred for the composition to comprise from 16 wt % to 20 wt % of a non-alkoxylated alkoxylated anionic detersive surfactant. This is especially preferred when the composition comprises from 1 wt % to 3 wt % alkoxylated anionic detersive surfactant. These amounts of anionic detersive surfactant provide a good greasy cleaning performance combined with a good hardness tolerency profile and a good sudsing profile. However, it may also be preferred for the composition to comprise from 4 wt % to 10 wt % non-alkoxylated anionic detersive surfactant. This is especially preferred when the composition comprises from 3 wt % to 5 wt % alkoxylated anionic detersive surfactant. These amounts of anionic detersive surfactant provide a good whiteness maintenance profile combined with a good hardness tolerency profile and a good sudsing profile.

The non-alkoxylated anionic detersive surfactant can be an alkyl sulphate, an alkyl sulphonate, an alkyl phosphate, an alkyl phosphonate, an alkyl carboxylate or any mixture thereof. The non-alkoxylated anionic surfactant can be selected from the group consisting of: $C_{10}$-$C_{18}$ alkyl benzene sulphonates (LAS) preferably $C_{10}$-$C_{13}$ alkyl benzene sulphonates; $C_{10}$-$C_{20}$ primary, branched-chain, linear-chain and random-chain alkyl sulphates (AS), typically having the following formula:

$$CH_3(CH_2)_xCH_2—OSO_3^-M^+$$

wherein, M is hydrogen or a cation which provides charge neutrality, preferred cations are sodium and ammonium cations, wherein x is an integer of at least 7, preferably at least 9; $C_{10}$-$C_{18}$ secondary (2,3) alkyl sulphates, typically having the following formulae:

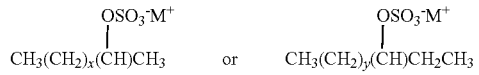

wherein, M is hydrogen or a cation which provides charge neutrality, preferred cations include sodium and ammonium cations, wherein x is an integer of at least 7, preferably at least 9, y is an integer of at least 8, preferably at least 9; $C_{10}$-$C_{18}$ alkyl alkoxy carboxylates; mid-chain branched alkyl sulphates as described in more detail in U.S. Pat. Nos. 6,020,303 and 6,060,443; modified alkylbenzene sulphonate (MLAS) as described in more detail in WO 99/05243, WO 99/05242, WO 99/05244, WO 99/05082, WO 99/05084, WO 99/05241, WO 99/07656, WO 00/23549, and WO 00/23548; methyl ester sulphonate (MES); alpha-olefin sulphonate (AOS) and mixtures thereof.

Preferred non-alkoxylated anionic detersive surfactants are selected from the group consisting of: linear or branched, substituted or unsubstituted, $C_{12-18}$ alkyl sulphates; linear or branched, substituted or unsubstituted, $C_{10-13}$ alkylbenzene sulphonates, preferably linear $C_{10-13}$ alkylbenzene sulphonates; and mixtures thereof. Highly preferred are linear $C_{10-13}$ alkylbenzene sulphonates. Highly preferred are linear $C_{10-13}$ alkylbenzene sulphonates that are obtainable, preferably obtained, by sulphonating commercially available linear alkyl benzenes (LAB); suitable LAB include low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®.

It may be preferred for the non-alkoxylated anionic detersive surfactant to be structurally modified in such a manner as to cause the non-alkoxylated anionic detersive surfactant to be more calcium tolerant and less likely to precipitate out of the wash liquor in the presence of free calcium ions. This structural modification could be the introduction of a methyl or ethyl moiety in the vicinity of the non-alkoxylated anionic detersive surfactant's head group, as this can lead to a more calcium tolerant non-alkoxylated anionic detersive surfactant due to steric hindrance of the head group, which may reduce the non-alkoxylated anionic detersive surfactant's affinity for complexing with free calcium cations in such a manner as to cause precipitation out of solution. Other structural modifications include the introduction of functional moieties, such as an amine moiety, in the alkyl chain of the non-alkoxylated anionic detersive surfactant; this can lead to a more calcium tolerant non-alkoxylated anionic detersive surfactant because the presence of a functional group in the alkyl chain of an non-alkoxylated anionic detersive surfactant may minimise the undesirable physicochemical property of the non-alkoxylated anionic detersive surfactant to form a smooth crystal structure in the presence of free calcium ions in the wash liquor. This may reduce the tendency of the non-alkoxylated anionic detersive surfactant to precipitate out of solution.

The non-alkoxylated anionic detersive surfactant is preferably in particulate form, such as an agglomerate, a spray-dried powder, an extrudate, a bead, a noodle, a needle or a flake. Preferably, the non-alkoxylated anionic detersive surfactant, or at least part thereof, is in agglomerate form; the agglomerate preferably comprising at least 20%, by weight of the agglomerate, of a non-alkoxylated anionic detersive surfactant, more preferably from 25 wt % to 65 wt %, by weight of the agglomerate, of a non-alkoxylated anionic detersive surfactant. It may be preferred for part of the non-alkoxylated anionic detersive surfactant to be in the form of a spray-dried powder (e.g. a blown powder), and for part of the non-alkoxylated anionic detersive surfactant to be in the form of a non-spray-dried powder (e.g. an agglomerate, or an extrudate, or a flake such as a linear alkyl benzene sulphonate flake; suitable linear alkyl benzene sulphonate flakes are supplied by Pilot Chemical under the tradename F90®, or by Stepan under the tradename Nacconol 90G®). This is especially preferred when it is desirable to incorporate high levels of non-alkoxylated anionic detersive surfactant in the composition.

Cationic Detersive Surfactant

The composition optionally may comprise from 0.1 wt % to 5 wt % cationic detersive surfactant. Preferably the composition comprises from 0.5 wt % to 3 wt %, or from 1% to 3 wt %, or even from 1 wt % to 2 wt % cationic detersive surfactant. This is the optimal level of cationic detersive surfactant to provide good cleaning. Suitable cationic detersive surfactants are alkyl pyridinium compounds, alkyl quaternary ammonium compounds, alkyl quaternary phosphonium compounds, and alkyl ternary sulphonium compounds. The cationic detersive surfactant can be selected from the group consisting of: alkoxylate quaternary ammonium (AQA) surfactants as described in more detail in U.S. Pat. No. 6,136,769; dimethyl hydroxyethyl quaternary ammonium as described in more detail in U.S. Pat. No. 6,004,922; polyamine cationic surfactants as described in more detail in WO 98/35002, WO 98/35003, WO 98/35004, WO 98/35005, and WO 98/35006; cationic ester surfactants as described in more detail in U.S. Pat. Nos. 4,228,042, 4,239,660, 4,260,529 and 6,022,844; amino surfactants as described in more detail in U.S. Pat. No. 6,221,825 and WO 00/47708, specifically amido propyldimethyl amine; and mixtures thereof. Preferred cationic detersive surfactants are quaternary ammonium compounds having the general formula:

$$(R)(R^1)(R^2)(R^3)N^+X^-$$

wherein, R is a linear or branched, substituted or unsubstituted $C_{6-18}$ alkyl or alkenyl moiety, $R^1$ and $R^2$ are independently selected from methyl or ethyl moieties, $R^3$ is a hydroxyl, hydroxymethyl or a hydroxyethyl moiety, X is an anion which provides charge neutrality, preferred anions include halides (such as chloride), sulphate and sulphonate. Preferred cationic detersive surfactants are mono-$C_{6-18}$ alkyl mono-hydroxyethyl di-methyl quaternary ammonium chlorides. Highly preferred cationic detersive surfactants are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride.

The cationic detersive surfactant provides additional greasy soil cleaning performance. However, the cationic detersive surfactant may increase the tendency of the non-alkoxylated anionic detersive surfactant to precipitate out of solution. Preferably, the cationic detersive surfactant and the non-alkoxylated anionic detersive surfactant are present in the composition in the form of separate particles. This minimises any effect that the cationic detersive surfactant may have on the undesirable precipitation of the non-alkoxylated anionic detersive surfactant, and also ensures that upon contact with water, the resultant wash liquor is not cloudy. Preferably, the weight ratio of non-alkoxylated anionic detersive surfactant to cationic detersive surfactant is in the range of from 5:1 to 25:1, more preferably from 5:1 to 20:1 or from 6:1 to 15:1, or from 7:1 to 10:1, or even from 8:1 to 9:1.

The cationic detersive surfactant is preferably in particulate form, such as a spray-dried powder, an agglomerate, an extrudate, a flake, a noodle, a needle, or any combination thereof. Preferably, the cationic detersive surfactant, or at least part thereof, is in the form of a spray-dried powder or an agglomerate.

Non-ionic Detersive Surfactant

The composition may comprises from 0.5 wt % to 10 wt % non-ionic detersive surfactant. Preferably the composition may comprises from 1 wt % to 7 wt % or from 2 wt % to 4 wt % non-ionic detersive surfactant. The inclusion of non-ionic detersive surfactant in the composition helps to provide a good overall cleaning profile, especially when laundering at high temperatures such as 60° C. or higher.

The non-ionic detersive surfactant can be selected from the group consisting of: $C_{12}$-$C_{18}$ alkyl ethoxylates, such as, NEODOL® non-ionic surfactants from Shell; $C_6$-$C_{12}$ alkyl phenol alkoxylates wherein the alkoxylate units are ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, BA, as described in more detail in U.S. Pat. No. 6,150,322; $C_{14}$-$C_{22}$ mid-chain branched alkyl alkoxylates, $BAE_x$, wherein x=from 1 to 30, as described in more detail in U.S. Pat. Nos. 6,153,577, 6,020,303 and 6,093,856; alkylpolysaccharides as described in more detail in U.S. Pat. No. 4,565,647, specifically alkylpolyglycosides as described in more detail in U.S. Pat. Nos. 4,483,780 and 4,483,779; polyhydroxy fatty acid amides as described in more detail in U.S. Pat. No. 5,332,528, WO 92/06162, WO 93/19146, WO 93/19038, and WO 94/09099; ether capped poly(oxyalkylated) alcohol surfactants as described in more detail in U.S. Pat. No. 6,482,994 and WO 01/42408; and mixtures thereof.

The non-ionic detersive surfactant could be an alkyl polyglucoside and/or an alkyl alkoxylated alcohol. Preferably the non-ionic detersive surfactant is a linear or branched, substituted or unsubstituted $C_{8-18}$ alkyl ethoxylated alcohol having an average degree of ethoxylation of from 1 to 10, more preferably from 3 to 7.

The non-ionic detersive surfactant not only provides additional greasy soil cleaning performance but may also increase the anionic detersive surfactant activity by making the anionic detersive surfactant less likely to precipitate out of solution in the presence of free calcium cations. Preferably, the weight ratio of non-alkoxylated anionic detersive surfactant to non-ionic detersive surfactant is in the range of less than 8:1, or less than 7:1, or less than 6:1 or less than 5:1, preferably from 1:1 to 5:1, or from 2:1 to 5:1, or even from 3:1 to 4:1.

The non-ionic detersive surfactant, or at least part thereof, can be incorporated into the composition in the form of a liquid spray-on, wherein the non-ionic detersive surfactant, or at least part thereof, in liquid form (e.g. in the form of a hot-melt) is sprayed onto the remainder of the composition. The non-ionic detersive surfactant, or at least part thereof, may be in particulate form, and the non-ionic detersive surfactant, or at least part thereof, may be dry-added to the remainder of the composition. The non-ionic surfactant, or at least part thereof, may be in the form of a co-particulate admixture with a solid carrier material such as carbonate salt, sulphate salt, burkeite, silica or any mixture thereof.

The non-ionic detersive surfactant, or at least part thereof, may be in a co-particulate admixture with either an alkoxylated anionic detersive surfactant, a non-alkoxylated anionic detersive surfactant or a cationic detersive surfactant. The non-ionic detersive surfactant, or at least part thereof, may be agglomerated or extruded with either an alkoxylated anionic detersive surfactant, a non-alkoxylated anionic detersive surfactant or a cationic detersive surfactant.

First, Second and Third Surfactant Components

The composition preferably comprises at least two separate surfactant components, each in particulate form. It may be preferred for the composition to comprise at least three separate surfactant components, each in particulate form.

The first surfactant component predominantly comprises an alkoxylated detersive surfactant. By predominantly comprises, it is meant that the first surfactant component comprises greater than 50%, by weight of the first surfactant component, of an alkoxylated anionic detersive surfactant, preferably greater than 60%, or greater than 70%, or greater than 80%, or greater than 90% or even essentially 100%, by weight of the first surfactant component, of an alkoxylated anionic detersive surfactant. Preferably, the first surfactant component comprises less than 10%, by weight of the first surfactant component, of a non-alkoxylated anionic detersive surfactant, preferably less than 5%, or less than 2%, or even 0%, by weight of the first surfactant component, of a non-alkoxylated anionic detersive surfactant. Preferably, the first surfactant component is essentially free from non-alkoxylated anionic detersive surfactant. By essentially free from non-alkoxylated anionic detersive surfactant it is typically meant that the first surfactant component comprises no deliberately added non-alkoxylated anionic detersive surfactant. This is especially preferred in order to ensure that the composition has good dispensing and dissolution profiles, and also to ensure that the composition provides a clear wash liquor upon dissolution in water.

If cationic detersive surfactant is present in the composition, then preferably the first surfactant component comprises less than 10%, by weight of the first surfactant component, of a cationic detersive surfactant, preferably less than 5%, or less than 2%, or even 0%, by weight of the first surfactant component, of a cationic detersive surfactant. Preferably, the first surfactant component is essentially free from cationic detersive surfactant. By essentially free from cationic detersive surfactant it is typically meant that the first surfactant component comprises no deliberately added cationic detersive surfactant. This is especially preferred in order to reduce the degree of surfactant gelling in the wash liquor.

The first surfactant component is preferably in the form of a spray-dried powder, an agglomerate, an extrudate or a flake. If the first surfactant component is in the form of an agglomerate particle or an extrudate particle, then preferably the particle comprises from 20% to 65%, by weight of the particle, of an alkoxylated anionic detersive surfactant. If the first surfactant component is in spray-dried particle form, then preferably the particle comprises from 10 wt % to 30 wt %, by weight of the particle, of an alkoxylated anionic detersive surfactant. The first surfactant component may be in the form of a co-particulate admixture with a solid carrier material. The solid carrier material can be a sulphate salt and/or a carbonate salt, preferably sodium sulphate and/or sodium carbonate.

The second surfactant component predominantly comprises a non-alkoxylated detersive surfactant. By predominantly comprises, it is meant the second surfactant component comprises greater than 50%, by weight of the second surfactant component, of a non-alkoxylated anionic detersive surfactant, preferably greater than 60%, or greater than 70%, or greater than 80%, or greater than 90% or even essentially 100%, by weight of the second surfactant component, of a non-alkoxylated anionic detersive surfactant. Preferably, the second surfactant component comprises less than 10%, by weight of the second surfactant component, of an alkoxylated anionic detersive surfactant, preferably less than 5%, or less than 2%, or even 0%, by weight of the second surfactant component, of an alkoxylated anionic detersive surfactant. If cationic detersive surfactant is present in the composition, then preferably the second surfactant component comprises less than 10%, by weight of the second surfactant component, of a cationic detersive surfactant, preferably less than 5%, or less than 2%, or even 0%, by weight of the second surfactant component, of a cationic detersive surfactant. Preferably, the second surfactant component is essentially free from alkoxylated anionic detersive surfactant. By essentially free from alkoxylated anionic detersive surfactant it is typically meant that the second surfactant component comprises no deliberately added alkoxylated anionic detersive surfactant. Preferably, the second surfactant component is essentially free from cationic detersive surfactant. By essentially free from cationic detersive surfactant it is typically meant that the second surfactant component comprises no deliberately added cationic detersive surfactant. This is especially preferred in order to ensure that the composition has good dispensing and dissolution profiles, and also to ensure that the composition provides a clear wash liquor upon dissolution in water.

The second surfactant component is preferably in the form of a spray-dried powder, a flash-dried powder, an agglomerate or an extrudate. If the second surfactant component is in the form of an agglomerate particle, then preferably the particle from 5% to 50%, by weight of the particle, of a non-alkoxylated anionic detersive surfactant, or from 5 wt % to 25 wt % non-alkoxylated anionic detersive surfactant. The second surfactant component may be in form of a co-particulate admixture with a solid carrier material. The solid carrier material can be a sulphate salt and/or a carbonate salt, preferably sodium sulphate and/or sodium carbonate.

The third surfactant component predominantly comprises a cationic detersive surfactant. By predominantly comprises, it is meant the third surfactant component comprises greater than 50%, by weight of the third surfactant component, of a cationic detersive surfactant, preferably greater than 60%, or greater than 70%, or greater than 80%, or greater than 90% or even essentially 100%, by weight of the third surfactant component, of a cationic detersive surfactant. Preferably, the third surfactant component comprises less than 10%, by weight of the third surfactant component, of an alkoxylated anionic detersive surfactant, preferably less than 5%, or less than 2%, or even essentially 0%, by weight of the third surfactant component, of an alkoxylated anionic detersive surfactant. Preferably the third surfactant component comprises less than 10%, by weight of the third surfactant component, of a non-alkoxylated anionic detersive surfactant, preferably less than 5%, or less than 2%, or even 0%, by weight of the third surfactant component, of a non-alkoxylated anionic detersive surfactant. Preferably, the third surfactant component is essentially free from alkoxylated anionic detersive surfactant. By essentially free from alkoxylated anionic detersive surfactant it is typically meant that the third surfactant component comprises no deliberately added alkoxylated anionic detersive surfactant. Preferably, the third surfactant component is essentially free from non-alkoxylated anionic detersive surfactant. By essentially free from non-alkoxylated anionic detersive surfactant it is typically meant that the third surfactant component comprises no deliberately added non-alkoxylated anionic detersive surfactant. This is especially preferred in order to ensure that the composition has good dispensing and dissolution profiles, and also to ensure that the composition provides a clear wash liquor upon dissolution in water.

The third surfactant component is preferably in the form of a spray-dried powder, a flash-dried powder, an agglomerate or an extrudate. If the third surfactant component is in the form of an agglomerate particle, then preferably the particle comprises from 5% to 50%, by weight of the particle, of cationic detersive surfactant, or from 5 wt % to 25 wt % cationic detersive surfactant. The third surfactant component may be in form of a co-particulate admixture with a solid carrier material. The solid carrier material can be a sulphate salt and/or a carbonate salt, preferably sodium sulphate and/or sodium carbonate.

Silicate Salt

The detergent composition comprises from 0 wt % to 10 wt % silicate salt. The composition preferably comprises from 0 wt % to 5 wt %, or less than 4 wt %, or less than 2 wt %, or less than 1 wt % silicate salt. It may even be preferred for the composition to be essentially free from silicate salt. By essentially free from silicate salt it is meant that the composition comprises no deliberately added silicate. This is especially preferred in order to ensure that the composition has a very good dispensing and dissolution profiles and to ensure that the composition provides a clear wash liquor upon dissolution in water. Silicate salts include water-insoluble silicates. Silicate salts include amorphous silicates and crystalline layered silicates (e.g. SKS-6). A preferred silicate salt is sodium silicate.

Zeolite Builder

The composition comprises from 0 wt % to 4 wt % zeolite builder. The composition preferably comprises from 0 wt % to 3 wt %, or from 0 wt % to 2 wt %, or from 0 wt % to 1 wt % zeolite builder. It may even be preferred for the composition to be essentially free from zeolite builder. By essentially free from zeolite builder it is typically meant that the composition comprises no deliberately added zeolite builder. This is especially preferred if it is desirable for the composition to be very highly soluble, to minimise the amount of water-insoluble residues (for example, which may deposit on fabric surfaces), and also when it is highly desirable to have transparent wash liquor. Zeolite builders include zeolite A, zeolite X, zeolite P and zeolite MAP.

Phosphate Builder

The composition comprises from 0 wt % to 4 wt % phosphate builder. The composition preferably comprises from 0 wt % to 3 wt %, or from 0 wt % to 2 wt %, or from 0 wt % to 1 wt % phosphate builder. It may even be preferred for the composition to be essentially free from phosphate builder. By essentially free from phosphate builder it is typically meant that the composition comprises no deliberately added phosphate builder. This is especially preferred if it is desirable for the composition to have a very good environmental profile. Phosphate builders include sodium tripolyphosphate.

Adjunct Builders

The composition may comprise adjunct builders other than the zeolite builder and phosphate builder, especially preferred are water-soluble adjunct builders. Adjunct builders are preferably selected from the group consisting of sodium carbonate, sulphamic acid and/or water-soluble salts thereof such as sodium sulphamate, citric acid and/or water soluble salts thereof such as sodium citrate; polymeric polycarboxylates such as co-polymers of acrylic acid and maleic acid, or polyacrylate.

It may be preferred for the composition to comprise very low levels of water-insoluble builders such as zeolite A, zeolite X, zeolite P and zeolite MAP whilst comprising relatively high levels of water-soluble adjunct builders, such as sodium carbonate, sulphamic acid and citric acid. It may be preferred for the weight ratio of sodium carbonate to zeolite builder to be at least 5:1, preferably at least 10:1, or at least 15:1, or at least 20:1 or even at least 25:1.

Carbonate Salt

It may be preferred for the detergent composition to comprise a carbonate salt, typically from 1 wt % to 50 wt %, or from 5 wt % to 25 wt % or from 10 wt % to 20 wt % carbonate salt. A preferred carbonate salt is sodium carbonate and/or sodium bicarbonate. A highly preferred carbonate salt is sodium carbonate. Preferably, the composition may comprise from 10 wt % to 20 wt % sodium carbonate. However, it may also be preferred for the composition to comprise from 2 wt % to 8 wt % sodium bicarbonate. Sodium bicarbonate at these levels provides good alkalinity whilst minimising the risk of surfactant gelling which may occur in surfactant-carbonate systems. If the composition comprises sodium carbonate and zeolite, then preferably the weight ratio of sodium carbonate to zeolite is at least 15:1.

The carbonate salt, or at least part thereof, is typically in particulate form, typically having a weight average particle size in the range of from 200 to 500 micrometers. However, it may be preferred for the carbonate salt, or at least part thereof, to be in micronised particulate form, typically having a weight average particle size in the range of from 4 to 40 micrometers; this is especially preferred when the carbonate salt, or at least part thereof, is in the form of a co-particulate admixture with a detersive surfactant, such as an alkoxylated anionic detersive surfactant.

High levels of carbonate improve the cleaning performance of the composition by increasing the pH of the wash liquor. This increased alkalinity improves the performance of the bleach, if present, increases the tendency of soils to hydrolyse which facilitates their removal from the fabric, and also increases the rate and degree of ionization of the soils to be cleaned; ionized soils are more soluble and easier to remove from the fabrics during the washing stage of the laundering process. In addition, high carbonate levels improve the flowability of the composition when the detergent composition is in free-flowing particulate form.

However, carbonate anions readily complex with calcium cations in the wash liquor to form calcium carbonate. Calcium carbonate is water-insoluble and can precipitate out of solution in the wash liquor and deposit on the fabric resulting in poor whiteness maintenance. Therefore, it may be preferred if the composition comprises low levels of, or no, carbonate salt. The composition may comprise from 0 wt % to 10 wt % carbonate salt to minimize the negatives associated with the presence of carbonate. However, as described above in more detail, it may be desirable to incorporate higher levels of carbonate salt in the composition. If the composition comprises high levels of carbonate salt, such as at least 10 wt % carbonate salt, then the composition also preferably comprises a source of acid that is capable of undergoing an acid/base reaction with a carbonate anion, such as sulphamic acid, citric acid, maleic acid, malic acid, succinic acid or any mixture thereof. An especially preferred source of acid is sulphamic acid. Preferably, the weight ratio of carbonate salt to the total amount of source of acid in the composition that is capable of undergoing an acid/base reaction with a carbonate anion, is preferably less than 50:1, more preferably less than 25:1, or less than 15:1, or less than 10:1 or even less than 5:1. If the composition comprises sodium carbonate and sulphamic acid, then preferably the weight ratio of sodium carbonate to sulphamic acid is less than 5:1.

Carbonate Anion Source

In order to minimise the undesirable effects of having too high a concentration of carbonate anions in the wash liquor, the total amount of carbonate anion source in the composition is preferably limited. Preferred carbonate anion sources are carbonate salts and/or percarbonate salts. Preferably, the total amount of carbonate anion source (on a carbonate anion basis) in the composition is between 7 wt % to 14 wt % greater than the theoretical amount of carbonate anion source that is required to completely neutralise the total amount of acid source present in the composition that is capable of undergoing an acid/base reaction with a carbonate anion. By controlling the total amount of carbonate anion source in the composition with respect to the amount of acid source in the composition, in the above described manner, all of the benefits of having of a carbonate anion source in the composition are maximised whilst all of the undesirable negative effects of having too high a concentration of carbonate anions in the wash liquor are minimised.

Sulphate Salt

The composition may preferably comprise at least 10 wt % sulphate salt. High levels of sulphate salt can improve the greasy stain removal cleaning performance of the composition. A preferred sulphate salt is sodium sulphate. Sodium sulphate and sulphamic acid are capable of complexing together in the presence of water to form a complex having the formula:

$$6\ HSO_3NH_2.5Na_2SO_4^-.15H_2O$$

Such complexes are suitable for use herein.

The composition may preferably comprise very high levels of sulphate; the detergent composition typically comprises at least 15 wt % sulphate salt, or even 20 wt % sulphate salt, or even 25 wt % sulphate salt and sometimes even at least 30 wt % sulphate salt. The sulphate salt, or at least part thereof, is typically in particulate form, typically having a weight average particle size in the range of from 60 to 200 micrometers. However, it may be preferred that the sulphate salt, or at least part thereof, is in micronised particulate form, typically having a weight average particle size in the range of from 5 to less than 60 micrometers, preferably from 5 to 40 micrometers. It may even be preferred for the sulphate salt to be in coarse particulate form, typically having a weight average particle size of from above 200 to 800 micrometers. However, it may also be preferred for the composition to comprise less than 20 wt % sulphate salt, or even less than 10 wt % or even less than 5 wt % sulphate salt.

The composition may preferably comprise less than 60 wt % total combined amount of carbonate salt and sulphate salt. The composition may comprise less than 55 wt %, or less than 50 wt %, or less than 45 wt %, or less than 40 wt % total combined amount of carbonate salt and sulphate salt.

Sulphamic Acid

The composition may comprise sulphamic acid and/or water-soluble salts thereof. The water-soluble salts of sulphamic acid can be alkali-metal or an alkaline-earth-metal salts of sulphamate. Other examples of water-soluble salts of sulphamic acid include ammonium sulphamate, zinc sulphamate and lead sulphamate. A preferred water-soluble salt of sulphamic acid is sodium sulphamate. Preferably, the detergent composition comprises sulphamic acid. The detergent composition preferably comprises (on a sulphamic acid basis) from 0.1 wt % to 20 wt % sulphamic acid, and/or water soluble salts thereof, however it may be preferred that the detergent composition comprises from 0.1 wt % to 15 wt %, or from 1 wt % to 12 wt %, or even from 3 wt % to 10 wt % sulphamic acid and/or water-soluble salts thereof. The sulphamic acid typically has the formula:

$$H_2NSO_3H$$

The sulphamic acid can be in zwitterionic form when present in the detergent composition; sulphamic acid in zwitterionic form has the formula:

$$H_3N^+SO_3^-$$

Possibly at least part of, possibly all of, the sulphamic acid is in zwitterionic form when present in the composition, for example as a separate particulate component.

The sulphamic acid can improve the dispensing and disintegration of the detergent composition. It is capable of reacting with a source of carbonate, if present, in an aqueous environment such as the wash liquor in the drum of an automatic washing machine or in the dispensing drawer of an automatic washing machine or some other dispensing device such as a ball (granulette) or a net, to produce carbon dioxide gas. The combination of sulphamic acid and a source of carbonate is an effervescence system that can improve the dispensing performance of the detergent composition. In addition, the extra agitation in the wash liquor provided by this effervescence system can also improve the cleaning performance of the detergent composition.

Sulphamic acid has a very low hygroscopicity, significantly lower than other acids such as citric acid, malic acid or succinic acid; sulphamic acid does not readily pick up water. Sulphamic acid is stable during storage of the detergent composition and does not readily degrade other components of the detergent composition under certain storage conditions such as high humidity. Surprisingly, the sulphamic acid is stable even in the presence of mobile liquid phases, for example non-ionic detersive surfactants. Even more surprisingly, the sulphamic acid does not readily degrade perfumes during storage under high humidity.

Preferably, the sulphamic acid, and/or water-soluble salts thereof, is in particulate form. When the detergent composition is in particulate form, especially a free-flowing particulate form, the sulphamic acid, and/or water-soluble salts thereof, is preferably in particulate form and preferably is incorporated into the detergent composition in the form of dry-added particles, preferably in the form of separate dry-added particles. Alternatively, the sulphamic acid may be in the form of a co-particulate admixture with a source of carbonate, this co-particulate admixture may be produced by methods such as agglomeration (including pressure agglomeration), roller compaction, extrudation, spheronisation, or any combination thereof. Preferably, the sulphamic acid, and/or water-soluble salts thereof, in particulate form has a weight average particle size in the range of from 210 micrometers to 1,200 micrometers, or preferably from 250 micrometers to 800 micrometers. Preferably, the sulphamic acid, and/or water-soluble salts thereof, in particulate form has a particle size distribution such that no more than 35 wt % of the sulphamic acid, and/or water-soluble salts thereof, has a particle size of less than 250 micrometers, preferably no more than 30 wt % of the sulphamic acid, and/or water-soluble salts thereof, has a particle size of less than 250 micrometers, and preferably no more than 35 wt % of the sulphamic acid, and/or water-soluble salts thereof, has a particle size of greater than 1,000 micrometers, preferably no more than 25 wt % of the sulphamic acid, and/or water-soluble salts thereof, has a particle size of greater than 1,000 micrometers.

Sulphamic acid, and/or water-soluble salts thereof, has a superior building capability than other acids such as citric acid, malic acid, succinic acid and salts thereof. Sulphamate, which is either incorporated in the composition or is formed in-situ in the wash liquor by the in-situ neutralisation of sulphamic acid, has a high binding efficiency with free cations (for example, such as calcium and/or magnesium cations to form calcium sulphamate and/or magnesium sulphamate, respectively). This superior building performance due to the presence of sulphamic acid, and/or water-soluble salts thereof, in the detergent composition is especially beneficial when the detergent composition comprises very low levels of, or no, zeolite builders and phosphate builders, when cleaning negatives associated with a high concentration of free calcium and/or magnesium are most likely to occur.

Polymeric Polycarboxylate

It may be preferred for the composition to comprise at least 1 wt %, or at least 2 wt %, or at least 3 wt %, or at least 4 wt %, or even at least 5 wt % polymeric polycarboxylates. High levels of polymeric polycarboxylate can act as builders and sequester free calcium ions in the wash liquor, they can also act as soil dispersants and can provide an improved particulate stain removal cleaning benefit. Preferred polymeric polycarboxylates include: polyacrylates, preferably having a weight average molecular weight of from 1,000 Da to 20,000 Da; co-polymers of maleic acid and acrylic acid, preferably having a molar ratio of maleic acid monomers to acrylic acid monomers of from 1:1 to 1:10 and a weight average molecular weight of from 10,000 Da to 200,000 Da, or preferably having a molar ratio of maleic acid monomers to acrylic acid monomers of from 0.3:1 to 3:1 and a weight average molecular weight of from 1,000 Da to 50,000 Da.

Soil Dispersant

It may also be preferred for the composition to comprise a soil dispersant having the formula:

$$\text{bis}((C_2H_5O)(C_2H_4O)n)(CH_3)\text{—}N^+\text{—}C_xH_{2x}\text{—}N^+\text{—}(CH_3)\text{-bis}((C_2H_5O)(C_2H_4O)n)$$

wherein, n=from 20 to 30, and x=from 3 to 8. Other suitable soil dispersants are sulphonate or sulphated soil dispersants having the formula:

$$\text{sulphonated or sulphated bis}((C_2H_5O)(C_2H_4O)n)(CH_3)\text{—}N^+\text{—}C_xH_{2x}\text{—}N^+\text{—}(CH_3)\text{-bis}((C_2H_5O)(C_2H_4O)n)$$

wherein, n=from 20 to 30, and x=from 3 to 8. Preferably, the composition comprises at least 1 wt %, or at least 2 wt %, or at least 3 wt % soil dispersants.

Other Adjunct Components

The composition typically comprises adjunct components. These adjunct components include: bleach such as percarbonate and/or perborate, preferably in combination with a bleach activator such as tetraacetyl ethylene diamine, oxybenzene sulphonate bleach activators such as nonanoyl oxybenzene sulphonate, caprolactam bleach activators, imide bleach activators such as N-nonanoyl-N-methyl acetamide, preformed peracids such as N,N-pthaloylamino peroxycaproic acid, nonylamido peroxyadipic acid or dibenzoyl peroxide; chelants such as diethylene triamine pentaacetate, diethylene triamine penta(methyl phosphonic acid), ethylene diamine-N'N'-disuccinic acid, ethylene diamine tetraacetate, ethylene diamine tetra(methylene phosphonic acid) and hydroxyethane di(methylene phosphonic acid); enzymes such as amylases, carbohydrases, cellulases, laccases, lipases, oxidases, peroxidases, proteases, pectate lyases and mannanases; suds suppressing systems such as silicone based suds suppressors; brighteners; photobleach; filler salts; fabric-softening agents such as clay, silicone and/or quaternary ammonium compounds; flocculants such as polyethylene oxide; dye transfer inhibitors such as polyvinylpyrrolidone, poly 4-vinylpyridine N-oxide and/or co-polymer of vinylpyrrolidone and vinylimidazole; fabric integrity components such as hydrophobically modified cellulose and oligomers produced by the condensation of imidazole and epichlorhydrin; soil dispersants and soil anti-redeposition aids such as polycarboxylates, alkoxylated polyamines and ethoxylated ethyleneimine polymers; anti-redeposition components such as carboxymethyl cellulose and polyesters; perfumes; and dyes such as orange dye.

Preferably, the composition comprises less than 1 wt % chlorine bleach and less than 1 wt % bromine bleach. Preferably, the composition is essentially free from bromine bleach and chlorine bleach. By "essentially free from" it is typically meant "comprises no deliberately added".

If the composition is for use for laundering delicate fabrics, then preferably the composition is essentially free from bleach, and/or essentially free from protease and/or from 0 wt % to less than 0.1 wt % fluorescent whitening components. By "essentially free from" it is typically meant "comprises no deliberately added". This is preferred when it is desirable to provide a good fabric care when laundering delicate fabrics such as silk and/or wool.

The composition may also preferably comprise from 0 wt % to less than 20 wt % sodium citrate, or from 0 wt % to 10 wt %, or from 0 wt % to 5 wt %, or from 0 wt % to 1 wt % sodium citrate. The composition may also preferably comprise from 0 wt % to 2 wt % trisodium sulphosuccinate, or from 0 wt % to 1 wt %, or from 0 wt % to 0.1 wt % trisodium sulphosuccinate. This is preferred in order to optimise the space in the formulation.

Composition

The composition can be in any solid form such as an agglomerate, a spray-dried power, an extrudate, a flake, a needle, a noodle, a bead, or any combination thereof. Preferably, the detergent composition is in the form of free-flowing particles. By free-flowing particles it is typically meant that the composition is in the form of separate discrete particles. The detergent composition in free-flowing particulate form typically has a bulk density of from 450 g/l to 1,000 g/l, preferred low bulk density detergent compositions have a bulk density of from 550 g/l to 650 g/l and preferred high bulk density detergent compositions have a bulk density of from 750 g/l to 900 g/l. During the laundering process, the composition is typically contacted with water to give a wash liquor having a pH of from above 7 to less than 13, preferably from above 7 to less than 10.5. This is the optimal pH to provide good cleaning whilst also ensuring a good fabric care profile.

The composition may be made by any suitable method including agglomeration, spray-drying, extrusion, mixing, dry-mixing, liquid spray-on, roller compaction, spheronisation or any combination thereof.

Preferably, the composition upon contact with water at a concentration of 9.2 g/l and at a temperature of 20° C., forms a transparent wash liquor having (i) a turbidity of less than 500 nephelometric turbidity units; and (ii) a pH in the range of from 8 to 12. Preferably, the resultant wash liquor has a turbidity of less than 400, or less than 300, or from 10 to 300 nephelometric turbidity units. The turbidity of the wash liquor is typically measured using a H1 93703 microprocessor turbidity meter. A typical method for measuring the turbidity of the wash liquor is as follows: 9.2 g of composition is added to 1 liter of water in a beaker to form a solution. The solution is stirred for 5 minutes at 600 rpm at 20° C. The turbidity of the solution is then measured using a H1 93703 microprocessor turbidity meter following the manufacturer's instructions.

The composition typically has an equilibrium relative humidity of from 0% to less than 30%, preferably from 0% to 20%, when measured at a temperature of 35° C. Typically, the equilibrium relative humidity is determined as follows:

Method for Determining the Equilibrium Relative Humidity of the Composition 300 g of composition is placed in a 1 liter container made of a water-impermeable material and fitted with a lid capable of sealing the container. The lid is provided with a sealable hole adapted to allow insertion of a probe into the interior of the container. The container and its contents are maintained at a temperature of 35° C. for 24 hours to allow temperature equilibration. A solid state hygrometer (Hygrotest 6100 sold by Testoterm Ltd, Hapshire, UK) is used to measure the water vapour pressure. This is done by inserting the probe into the interior of the container via the sealable hole in the container's lid and measuring the water vapour pressure of the head space. These measurements are made at 10 minute intervals until the water vapour pressure has equilibrated. The probe then automatically converts the water vapour pressure reading into an equilibrium relative humidity value.

Detergent Product

The detergent product comprises a combination of The composition and a packaging system. The composition is defined in more detail above. The packaging system is defined in more detail below. The packaging system has a moisture vapour transfer rate of from 0 $gm^{-2}day^{-1}$, preferably less than 10 $gm^{-2}day^{-1}$. The moisture vapour transfer rate is typically measured by any suitable method known in the art, preferred methods include ASTM Standard E-96-53T or TAPPI Standard T464 m-45. The preferred method is ASTM Standard E-96-53T. The packaging system may be in the form of a box, bag, bottle, tin, can, packet, sachet, drum. Preferably, the packaging system is in the form of a bottle. Preferably, the bottle is translucent. The stability of the composition is improved when it is stored in a packaging system having a very low vapour transfer rate.

EXAMPLES

Example 1

A Particulate Laundry Detergent Composition and Process of Making it

Aqueous slurry composition.

| Component | % w/w Aqueous slurry |
|---|---|
| A compound having the following general structure: bis($(C_2H_5O)(C_2H_4O)n$)($CH_3$)—$N^+$—$C_xH_{2x}$—$N^+$—($CH_3$)-bis($(C_2H_5O)(C_2H_4O)n$), wherein n = from 20 to 30, and x = from 3 to 8, or sulphated or sulphonated variants thereof | 1.23 |
| Ethylenediamine disuccinic acid | 0.35 |
| Brightener | 0.12 |
| Magnesium sulphate | 0.72 |
| Acrylate/maleate copolymer | 6.45 |
| Linear alkyl benzene sulphonate | 11.92 |
| Hydroxyethane di(methylene phosphonic acid) | 0.32 |
| Sodium carbonate | 4.32 |
| Sodium sulphate | 47.49 |
| Soap | 0.78 |
| Water | 25.89 |
| Miscellaneous | 0.42 |
| Total Parts | 100.00 |

Preparation of a Spray-dried Powder.

An aqueous slurry having the composition as described above is prepared having a moisture content of 25.89%. The aqueous slurry is heated to 72° C. and pumped under high pressure (from $5.5\times10^6 Nm^{-2}$ to $6.0\times10^6 Nm^{-2}$), into a counter current spray-drying tower with an air inlet temperature of from 270° C. to 300° C. The aqueous slurry is atomised and the atomised slurry is dried to produce a solid mixture, which is then cooled and sieved to remove oversize material (>1.8 mm) to form a spray-dried powder, which is free-flowing. Fine material (<0.15 mm) is elutriated with the exhaust the exhaust air in the spray-drying tower and collected in a post tower containment system. The spray-dried powder has a moisture content of 1.0 wt %, a bulk density of 427 g/l and a particle size distribution such that 95.2 wt % of the spray-dried powder has a particle size of from 150 to 710 micrometers. The composition of the spray-dried powder is given below.

Spray-dried powder composition.

| Component | % w/w Spray-dried powder |
|---|---|
| A compound having the following general structure: bis($(C_2H_5O)(C_2H_4O)n$)($CH_3$)—$N^+$—$C_xH_{2x}$—$N^+$—($CH_3$)-bis($(C_2H_5O)(C_2H_4O)n$), wherein n = from 20 to 30, and x = from 3 to 8, or sulphated or sulphonated variants thereof | 1.65 |
| Ethylenediamine disuccinic acid | 0.47 |
| Brightener | 0.16 |
| Magnesium sulphate | 0.96 |
| Acrylate/maleate copolymer | 8.62 |
| Linear alkyl benzene sulphonate | 15.92 |
| Hydroxyethane di(methylene phosphonic acid) | 0.43 |
| Sodium carbonate | 5.77 |
| Sodium sulphate | 63.43 |
| Soap | 1.04 |
| Water | 1.00 |
| Miscellaneous | 0.55 |
| Total Parts | 100.00 |

Preparation of an Anionic Surfactant Particle 1

The anionic detersive surfactant particle 1 is made on a 520 g batch basis using a Tilt-A-Pin then Tilt-A-Plow mixer (both made by Processall). 108 g sodium sulphate supplied is added to the Tilt-A-Pin mixer along with 244 g sodium carbonate. 168 g of 70% active $C_{25}E_3S$ paste (sodium ethoxy sulphate based on $C_{12/15}$ alcohol and ethylene oxide) is added to the Tilt-A-Pin mixer. The components are then mixed at 1200 rpm for 10 seconds. The resulting powder is then transferred into a Tilt-A-Plow mixer and mixed at 200 rpm for 2 minutes to form particles. The particles are then dried in a fluid bed dryer at a rate of 2500 l/min at 120° C. until the equilibrium relative humidity of the particles is less than 15%. The dried particles are then sieved and the fraction through 1180 μm and on 250 μm is retained The composition of the anionic detersive surfactant particle 1 is as follows:

25.0% w/w $C_{25}E_3S$ sodium ethoxy sulphate 18.0% w/w sodium sulphate 57.0% w/w sodium carbonate Preparation of a Cationic Detersive Surfactant Particle 1

The cationic surfactant particle 1 is made on a 14.6 kg batch basis on a Morton FM-50 Loedige mixer. 4.5 kg of micronised sodium sulphate and 4.5 kg micronised sodium carbonate are premixed in the Morton FM-50 Loedige mixer. 4.6 kg of 40% active mono-$C_{12-14}$ alkyl mono-hydroxyethyl di-methyl quaternary ammonium chloride (cationic surfactant) aqueous solution is added to the Morton FM-50 Loedige mixer whilst both the main drive and the chopper are operating. After approximately two minutes of mixing, a 1.0 kg 1:1 weight ratio mix of micronised sodium sulphate and micronised sodium carbonate is added to the mixer. The resulting agglomerate is collected and dried using a fluid bed dryer on a basis of 2500 l/min air at 100-140° C. for 30 minutes. The resulting powder is sieved and the fraction through 1400 μm is collected as the cationic surfactant particle 1. The composition of the cationic surfactant particle 1 is as follows:

15% w/w mono-$C_{12-14}$ alkyl mono-hydroxyethyl di-methyl quaternary ammonium chloride 40.76% w/w sodium carbonate 40.76% w/w sodium sulphate 3.48% w/w moisture and miscellaneous Preparation of a Granular Laundry Detergent Composition 10.84 kg of the spray-dried powder of example 1, 4.76 kg of the anionic detersive surfactant particle 1, 1.57 kg of the cationic detersive surfactant particle 1 and 7.83 kg (total amount) of other individually dosed dry-added material are dosed into a 1 m diameter concrete batch mixer operating at 24 rpm. Once all of the materials are dosed into the mixer, the mixture is mixed for 5 minutes to form a granular laundry detergent composition. The formulation of the granular laundry detergent composition is described below:

A granular laundry detergent composition.

| Component | % w/w granular laundry detergent composition |
|---|---|
| Spray-dried powder of example 1 | 43.34 |
| 91.6 wt % active linear alkyl benzene sulphonate flake supplied by Stepan under the tradename Nacconol 90G ® | 0.22 |

-continued

A granular laundry detergent composition.

| Component | % w/w granular laundry detergent composition |
|---|---|
| Citric acid | 5.00 |
| Sodium percarbonate (having from 12% to 15% active AvOx) | 14.70 |
| Photobleach particle | 0.01 |
| Lipase (11.00 mg active/g) | 0.70 |
| Amylase (21.55 mg active/g) | 0.33 |
| Protease (56.00 mg active/g) | 0.43 |
| Tetraacetyl ethylene diamine agglomerate (92 wt % active) | 4.35 |
| Suds suppressor agglomerate (11.5 wt % active) | 0.87 |
| Acrylate/maleate copolymer particle (95.7 wt % active) | 0.29 |
| Green/Blue carbonate speckle | 0.50 |
| Anionic detersive surfactant particle 1 | 19.04 |
| Cationic detersive surfactant particle 1 | 6.27 |
| Sodium sulphate | 3.32 |
| Solid perfume particle | 0.63 |
| Total Parts | 100.00 |

Examples 2-10

Particulate Laundry Detergent Compositions

Amounts of ingredients given below are in wt %.

| composition | Example 2 | 3 | 4 | 5 | 6 | 7 | 8 | 9 | 10 |
|---|---|---|---|---|---|---|---|---|---|
| Spay-dried powder | | | | | | | | | |
| A compound having the following general structure: bis($(C_2H_5O)(C_2H_4O)n$)($CH_3$)—$N^+$—$C_xH_{2x}$—$N^+$—($CH_3$)-bis($(C_2H_5O)(C_2H_4O)n$), wherein n = from 20 to 30, and x = from 3 to 8, or sulphated or sulphonated variants thereof | 0.72 | | 0.72 | 0.72 | 0.72 | 0.72 | | | |
| Diethylene triamine penta(methyl phosphonic) acid | | | | | | | 0.19 | 0.13 | 0.20 |
| Citric acid | | | | | | | 2.81 | | |
| Ethylenediamine disuccinic acid | 0.20 | | 0.20 | 0.20 | 0.20 | 0.20 | 0.09 | | |
| Brightener | 0.07 | | 0.07 | 0.07 | 0.07 | 0.07 | | 0.10 | 0.06 |
| Magnesium sulphate | 0.42 | | 0.42 | 0.42 | 0.42 | 0.42 | | | |
| Acrylate/maleate copolymer | 3.74 | 5.00 | 3.74 | 3.74 | 3.74 | 3.74 | | 2.40 | 0.62 |
| Soil release polymer | | | | | | | | | 0.62 |
| Linear alkyl benzene sulphonate | 6.90 | 18.00 | 6.90 | 6.90 | 6.90 | 6.90 | 10.22 | 9.47 | 9.96 |
| Sodium $C_{12-15}$ alkyl ethoxy sulphate having a molar average degree of ethoxylation of 3 | | 2.00 | | | | | | | |
| Tallow ($C_{16-18}$) alkyl ethoxylated alcohol having a molar average degree of ethoxylation of 5 | | | | | | | | 0.90 | |
| Tallow ($C_{16-18}$) alkyl ethoxylated alcohol having a molar average degree of ethoxylation of 80 | | 2.70 | | | | | | | |
| Hydroxyethane di(methylene phosphonic acid) | 0.19 | | 0.19 | 0.19 | 0.19 | 0.19 | 0.30 | 0.47 | 0.13 |
| Carboxyl methyl cellulose | | | | | | | 1.60 | 2.37 | 0.56 |
| Sodium carbonate | 2.50 | 18.00 | 2.50 | 2.50 | 2.50 | 10.93 | 20.02 | 11.63 | 7.27 |
| Sodium sulphate | 27.49 | 38.03 | 27.49 | 27.49 | 27.49 | 19.06 | | 12.55 | 6.89 |
| Sodium silicate 2.0R | | | | | | | 4.76 | 1.78 | 6.96 |
| Sodium toluene sulphonate | | 0.90 | | | | | | | |
| Caustic soda | | 0.12 | | | | | | | |
| Sodium citrate | | | | | | | | 2.83 | |
| Soap | 0.45 | | 0.45 | 0.45 | 0.45 | 0.45 | 1.03 | 0.50 | 1.35 |
| PEG 4000 | | | | | | | | 0.25 | |
| Zeolite MAP | | | | | | | | | 21.87 |
| Water | 0.43 | 5.40 | 0.43 | 0.43 | 0.43 | 0.43 | 0.43 | 3.71 | 2.59 |
| Miscellaneous | 0.24 | 0.73 | 0.24 | 0.24 | 0.24 | 0.24 | 1.11 | 2.82 | 1.52 |
| Total amount of spray-dried powder | 43.34 | 90.88 | 43.34 | 43.34 | 43.34 | 43.34 | 42.56 | 51.91 | 60.61 |

-continued

Amounts of ingredients given below are in wt %.

| composition | Example 2 | 3 | 4 | 5 | 6 | 7 | 8 | 9 | 10 |
|---|---|---|---|---|---|---|---|---|---|
| AES surfactant agglomerate | | | | | | | | | |
| Sodium $C_{12-15}$ alkyl ethoxy sulphate having a molar average degree of ethoxylation of 3 | 4.76 | | 4.76 | 2.38 | 4.76 | 4.76 | 0.48 | 2.38 | |
| Sodium carbonate | 10.85 | | 10.85 | 5.43 | 10.85 | 14.28 | 1.09 | 5.43 | |
| Sodium sulphate | 3.43 | | 3.43 | 1.72 | 3.43 | 0.00 | 0.34 | 1.72 | |
| Total amount of AES surfactant agglomerate | 19.04 | | 19.04 | 9.52 | 19.04 | 19.04 | 1.90 | 9.52 | |
| Cationic surfactant agglomerate | | | | | | | | | |
| Mono-$C_{12-14}$ alkyl monohydroxyethyl di-methyl quaternary ammonium chloride | 0.94 | | 0.94 | 0.94 | 0.94 | 0.94 | | | |
| Sodium carbonate | 2.67 | 4.00 | 2.67 | 2.67 | 2.67 | 5.33 | | | |
| Sodium sulphate | 2.67 | | 2.67 | 2.67 | 2.67 | 0.00 | | | |
| Total amount of cationic surfactant agglomerate | 6.27 | | 6.27 | 6.27 | 6.27 | 6.27 | | | |
| Non-ionic surfactant particle | | | | | | | | | |
| $C_{14-15}$ alkyl ethoxylated alcohol having a molar average degree of ethoxylation of 7 | | | | 2.00 | | | | | |
| Sodium sulphate | | | | 8.20 | | | | | |
| Total amount of non-ionic surfactant particle | | | | 10.20 | | | | | |
| Dry added/Spray on components | | | | | | | | | |
| $C_{12-15}$ alkyl ethoxylated alcohol having a molar average degree of ethoxylation of 3 (AE3) | | | | | | | | | 3.36 |
| Sodium carbonate | | | | | | | | | 8.82 |
| 91.6 wt % active linear alkyl benzene sulphonate flake supplied by Stepan under the tradename Nacconol 90G ® | 0.22 | | 0.22 | 0.22 | 0.22 | 0.22 | | | |
| Polyvinylpyrrolidone | | 0.20 | | | | | | | |
| Citric acid | 5.00 | 0.50 | 5.00 | 5.00 | | 5.00 | 0.93 | | 3.08 |
| Sulphamic acid | | | | | 5.00 | | | | |
| Sodium percarbonate (having from 12% to 15% active AvOx) | 14.70 | | 14.70 | 14.70 | 14.70 | 18.02 | 14.21 | 19.63 | 13.24 |
| Sodium bicarbonate | | 3.17 | 3.00 | | | | | | |
| Photobleach particle | 0.01 | | 0.01 | 0.01 | 0.01 | 0.01 | | | |
| Lipase (11.00 mg active/g) | 0.70 | | 0.70 | 0.70 | 0.70 | 0.70 | | 0.70 | 0.70 |
| Amylase (21.55 mg active/g) | 0.33 | | 0.33 | 0.33 | 0.33 | 0.33 | 0.63 | 0.33 | 0.33 |
| Protease (56.00 mg active/g) | 0.43 | | 0.43 | 0.43 | 0.43 | 0.43 | 0.36 | 0.33 | |
| Protease (32.89 mg active/g) | | | | | | | | | 0.54 |
| Cellulase (2.3 mg active/g) | | | | | | | 0.15 | | 0.18 |
| Tetraacetyl ethylene diamine agglomerate (92 wt % active) | 4.35 | | 4.35 | 4.35 | 4.35 | 4.35 | 2.59 | 6.50 | 2.43 |
| Suds suppressor agglomerate (11.5 wt % active) | 0.87 | 0.50 | 0.87 | 0.87 | 0.87 | 0.87 | 2.50 | 2.60 | |
| Suds suppressor agglomerate (12.6 wt % active) | | | | | | | | | 1.98 |
| Acrylate/maleate copolymer particle (95.7 wt % active) | 0.29 | | 0.29 | 0.29 | 0.29 | 0.29 | | | |
| Green/blue carbonate speckle | 0.50 | | 0.50 | 0.50 | 0.50 | 0.50 | | 2.50 | |
| Blue carbonate speckle | | | | | | | 2.00 | | |
| Blue phosphate speckle | | | | | | | 4.19 | | |
| Sodium sulphate | 3.32 | | 0.32 | 2.64 | 3.32 | 0.00 | 27.53 | 5.98 | 4.40 |
| Perfume | 0.63 | 0.75 | 0.63 | 0.63 | 0.63 | 0.63 | 0.44 | | 0.33 |
| Total amount | 100.00 | 100.00 | 100.00 | 100.00 | 100.00 | 100.00 | 100.00 | 100.00 | 100.00 |

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention. All documents cited herein are in relevant part, incorporated by reference. The citation of any document is not to be construed as an admission that it is prior art with respect to the present invention.

All documents cited in the Detailed Description of the Invention are, in relevant part, incorporated herein by reference; the citation of any document is not to be construed as an admission that it is prior art with respect to the present invention

The invention claimed is:

1. A solid laundry detergent composition comprising:

(a) from 0.1 wt % to 10 wt % of an alkoxylated anionic detersive surfactant;

(b) from 1 wt % to 25 wt % of a non-alkoxylated anionic detersive surfactant;

(c) from 0.5 wt % to 3 wt % of a cationic detersive surfactant (d) from 0 wt % to 4 wt % of a zeolite builder;

(e) from 0 wt % to 4 wt % of a phosphate builder; and (f) from 0 wt % to 10 wt % of a silicate salt wherein the composition comprises at least two separate surfactant components, each in particulate form:

(1) a first surfactant component consisting of said alkoxylated anionic detersive surfactant, and a solid carrier selected from the group consisting of a sulphate salt, a carbonate salt, or a mixture thereof; and optionally a non-alkoxylated anionic detersive surfactant, a cationic detersive surfactant, and a mixture thereof, (2) a second surfactant component comprising said non-alkoxylated anionic detersive surfactant.

2. The composition according to claim 1, wherein (1) said cationic detersive surfactant, if present, is less than 5%, by weight of the first surfactant component; (2) said non-alkoxylated anionic detersive surfactant, if present, is less than 5%, by weight of the first surfactant component;

and wherein the second surfactant component comprises:

(3) less than 5%, by weight of the second surfactant component, of said cationic detersive surfactant; and (4) less than 5%, by weight of the second surfactant component, of said alkoxylated anionic detersive surfactant.

3. The composition according to claim 2, wherein said non-alkoxylated anionic detersive surfactant, if present, is less than 2%, by weight of the first surfactant component.

4. The composition according to claim 2, wherein the second surfactant component comprises less than 2%, by weight of the second surfactant component, of an alkoxylated anionic detersive surfactant.

5. The composition according to claim 1, wherein at least part of the non-alkoxylated anionic detersive surfactant is in the form of a spray-dried powder, and wherein at least part of the alkoxylated anionic detersive surfactant is in the form of a non-spray-dried powder.

6. The composition according to claim 1, wherein at least part of the alkoxylated anionic detersive surfactant is in agglomerate form, and wherein the weight ratio of non-alkoxylated anionic detersive surfactant to alkoxylated anionic detersive surfactant is greater than 7:1.

7. The composition according to claim 1, wherein the composition comprises from 16 wt % to 20 wt % non-alkoxylated anionic detersive surfactant and from 1 wt % to 3 wt % alkoxylated anionic detersive surfactant.

8. The composition according to claim 1, wherein the weight ratio of non-alkoxylated anionic detersive surfactant to alkoxylated anionic detersive surfactant is less than 1.7:1.

9. The composition according to claim 1, wherein the composition comprises from 4 wt % to 10 wt % non-alkoxylated anionic detersive surfactant and from 3 wt % to 5 wt % alkoxylated anionic detersive surfactant.

10. The composition according to claim 1, wherein the non-alkoxylated anionic detersive surfactant is selected from the group consisting of: $C_{10-13}$ linear alkylbenzene sulphonate (LAS); linear or branched, substituted or unsubstituted $C_{12-18}$ alkyl sulphate; and mixtures thereof.

11. The composition according to claim 1, wherein the alkoxylated anionic detersive surfactant is a linear or branched, substituted or unsubstituted $C_{12-18}$ alkyl ethoxylated sulphate having an average ethoxylation degree of from 1 to 10.

12. The composition according to claim 1, wherein the cationic detersive surfactant is a mono-$C_{6-18}$ alkyl monohydroxyethyl di-methyl quaternary ammonium chloride.

13. The composition according to claim 1, wherein the composition is essentially free from silicate salt, zeolite builder, and/or phosphate builder.

14. The composition according to claim 1, wherein the composition comprises from 10 wt % to 20 wt % sodium carbonate.

15. The composition according to claim 1, wherein the composition comprises from 2 wt % to 8 wt % sodium carbonate, and wherein if the composition also comprises a zeolite builder, then the weight ratio of sodium carbonate to zeolite builder is at least 15:1.

16. The composition according to claim 1, wherein the composition comprises:

(a) a carbonate anion source; and (b) an acid source that is capable of undergoing an acid/base reaction with a carbonate anion, wherein the total amount of carbonate anion source, on a carbonate anion basis, in the composition is from 7 wt % to 14 wt % greater than the theoretical amount of carbonate anion source that is required to completely neutralize the total amount of acid source present in the composition that is capable of undergoing an acid/base reaction with a carbonate anion, wherein the composition comprises sodium carbonate in micronized particulate form.

17. The composition according to claim 1, wherein the composition comprises sodium carbonate and sulphamic acid, and/or water-soluble salts thereof, and wherein if the composition comprises more than 10 wt % sodium carbonate then the weight ratio of sodium carbonate to sulphamic acid is less than 5:1.

18. The composition according to claim 1, further comprising a third surfactant component comprising said cationic detersive surfactant.

19. The composition according to claim 18, wherein the third surfactant component comprises:

(a) less than 5%, by weight of the third surfactant component, of an alkoxylated anionic detersive surfactant; and (b) less than 5%, by weight of the third surfactant component, of a non-alkoxylated anionic detersive surfactant.

20. The composition according to claim 19, wherein the third surfactant component is essentially free of: an alkoxylated anionic detersive surfactant and a non-alkoxylated anionic detersive surfactant; wherein the first surfactant component is essentially free of: a cationic detersive surfactant and a non-alkoxylated anionic detersive surfactant; and wherein the second surfactant component is essentially free of: a cationic detersive surfactant and an alkoxylated anionic detersive surfactant.

21. The composition according to claim 19, wherein the third surfactant component comprises:

(a) less than 2%, by weight of the third surfactant component, of an alkoxylated anionic detersive surfactant; and (b) less than 2%, by weight of the third surfactant component, of a non-alkoxylated anionic detersive surfactant;

wherein (c) said cationic detersive surfactant, if present, is less than 2%, by weight of the first surfactant component; (d) said non-alkoxylated anionic detersive surfactant, if present, is less than 2%, by weight of the first surfactant component; and wherein the second surfactant component comprises:

(e) less than 2%, by weight of the second surfactant component, of a cationic detersive surfactant; and (f) less than 2%, by weight of the second surfactant component, of an alkoxylated anionic detersive surfactant.

* * * * *

UNITED STATES PATENT AND TRADEMARK OFFICE

CERTIFICATE OF CORRECTION

PATENT NO. : 7,605,116 B2
APPLICATION NO. : 11/201523
DATED : October 20, 2009
INVENTOR(S) : Brooker et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 504 days.

Signed and Sealed this

Fifth Day of October, 2010

David J. Kappos

David J. Kappos
*Director of the United States Patent and Trademark Office*